US005242127A

United States Patent [19]

Jääskeläinen

[11] Patent Number: 5,242,127

Date of Patent: Sep. 7, 1993

[54] REEL LIFTING DEVICE WITH SUPPORT ARMS MOUNTED FOR FLEXIBLE MOVEMENT

[75] Inventor: Vesa Jääskeläinen, Gökärtsvägen, Sweden

[73] Assignee: Nokia Maillefer Oy, Finland

[21] Appl. No.: 778,124

[22] PCT Filed: Jun. 5, 1990

[86] PCT No.: PCT/FI90/00150

§ 371 Date: Dec. 4, 1991

§ 102(e) Date: Dec. 4, 1991

[87] PCT Pub. No.: WO90/15771

PCT Pub. Date: Dec. 27, 1990

[30] Foreign Application Priority Data

Jun. 13, 1989 [FI] Finland ..... 892889

[51] Int. Cl.[5] ..... B65H 75/00; B65H 19/30

[52] U.S. Cl. ..... 242/54 R; 242/58.6; 242/68.4

[58] Field of Search ..... 242/54 R, 58.6, 68.4, 242/85

[56] References Cited

U.S. PATENT DOCUMENTS

| | | | |
|---|---|---|---|
| 1,874,904 | 8/1932 | Crafts | 242/58.6 |
| 3,123,314 | 3/1964 | Bruestle | 242/54 |
| 4,098,468 | 7/1978 | Skalleberg | 242/54 R |
| 4,679,743 | 7/1987 | Dallmaier | 242/54 R |

FOREIGN PATENT DOCUMENTS

| | | | |
|---|---|---|---|
| 1038453 | 3/1957 | Fed. Rep. of Germany | 242/58.6 |
| 1961378 | 12/1970 | Fed. Rep. of Germany . | |
| 1474238 | 2/1973 | Fed. Rep. of Germany . | |
| 2519070 | 1/1975 | Fed. Rep. of Germany . | |
| 2573738 | 5/1986 | France . | |
| 392185 | 3/1977 | Sweden . | |
| 399864 | 3/1978 | Sweden . | |
| 1514439 | 6/1978 | United Kingdom . | |
| 1568633 | 6/1980 | United Kingdom . | |
| 2214532 | 9/1989 | United Kingdom . | |

*Primary Examiner*—Daniel P. Stodola
*Assistant Examiner*—John Rollins
*Attorney, Agent, or Firm*—Finnegan, Henderson, Farabow, Garrett & Dunner

[57] ABSTRACT

An apparatus for reeling or unreeling a cable, comprising an upright frame (1) and two supports (4) fastened vertically stationary to the frame, each support being provided with a vertically movable suspending arm (5) having a reel gripping pin at its lower end. To reduce the masses to be moved and to compensate for differences in the positions of the centers of a deformed reel, each stationary support (4) comprises an abutment (14) which in an uppermost position of the suspending arm (5) supports the suspending arm rigidly to the frame through the support, whereby each suspending arm (5) is supported by the stationary support by a spring (12) which in a lowered gripping position of the suspending arm allows a flexible movement of the suspending arm with respect to the support in the axial direction of the suspending arm and a horizontal swinging movement in a plane perpendicular to the axis of the reel.

4 Claims, 3 Drawing Sheets 1
2
3
4
5
6
7
8
9''
10
11
12
13
14
15
A
B 1
2
3
4
5
6
7
8
9'
10
11
12
13
14
15
B

REEL LIFTING DEVICE WITH SUPPORT ARMS MOUNTED FOR FLEXIBLE MOVEMENT

This invention relates to an apparatus for reeling or unreeling a cable or the like, comprising a frame, two supports mounted vertically immovably on the frame, said supports being horizontally movable towards and away from each other in accordance with the axial width of a reel, a suspending arm mounted in each support, said suspending arm being provided at the lower end with a gripping means for gripping a centre of the reel and arranged displaceably in vertical direction with respect to the support over a distance corresponding to the sum of a height difference between the centre of a largest reel and the centre of a smallest reel and a lifting distance of the largest reel, and power means to vertically displace the suspending arms.

This kind of apparatus is used especially in the cable industry for reeling or unreeling cables, but the apparatus is equally applicable when reeling other similar products, such as ropes. The purpose of the apparatus is to raise the reel so that it can be rotated about its central axis. The apparatus comprises gripping pins for gripping the reel from a central hole or from some other lifting means provided on opposite sides of the reel. Even though the reels are originally symmetrical on both sides, and the central holes are positioned accurately on the same horizontal axis, the reels and especially their two flanges may be damaged and deformed in use so that the reel to be lifted is no longer positioned in an upright position on the underlying surface but slants so that the central holes of the reel are positioned at different heights with respect to each other. The same situation occurs when the underlying surface has worn unevenly. Therefore the gripping pins of the apparatus must be able to compensate for height differences between the central holes. In addition to this, the apparatus should, of course, be able to handle reels of different diameters.

Finnish Patent Specification 61012 (Swedish Patent Specification 392,185) discloses a cable reeling apparatus in which the gripping pins are fastened to suspending arms mounted vertically displaceably in supports fastened to the frame of the apparatus, more precisely, to horizontal beams supported by two columns of the frame. The supports are thereby fastened to the horizontal beams in such a way that the supports maintain their vertical position relative to the horizontal beams but are nevertheless horizontally moveable along the beams. For gripping the reel, the suspending arms can be raised and lowered so that the reels can be raised off the floor level sufficiently to be rotated freely.

This kind of cable reeling apparatus, however, has certain major disadvantages. Since the supports for the suspending arms are fastened to the frame vertically immovably, the suspending arms have to be lowered rather a long distance in order that the gripping pins of the suspending arms could be pushed into engagement with the central holes of the reel. After raising the suspending arms to such an extent that the reel is able to rotate, the suspending arms remain rather long. The rotation of the reel causes considerable stresses in the suspending arms, which results in vibration and swaying and may disturb the reeling and possibly damage the suspending arms. A further disadvantage is that to prevent swaying of the suspending arms during the reeling, the suspending arms must be journalled in their supports with a clearance as small as possible. As a result of this, the gripping pins in the lower ends of the suspending arms are not able to be displaced to any greater degree in the sideward direction in their lowered position. Therefore, the gripping pins are not able to find central holes which have been displaced slightly from the original position due to damage or for some other reason.

To avoid these disadvantages, cable reeling apparatuses have been developed in which the supports for the suspending arms are vertically movable with respect to the frame. One such apparatus is disclosed in Finnish Patent Specification 60542 (German Patent Specification 27 13 866). This apparatus is able to both handle reels of different diameters and compensate for minor height differences between the central holes of the reel. This, however, is achieved by means of a rather complicated construction. The supports for the suspending rods are mounted vertically moveably on separate columns, which requires that the supports are provided with separate lifting and lowering mechanisms as well. In addition, the two suspending arms provided with the gripping pins are each provided with a separate machinery by means of which the gripping pin is displaceable between a locked position and a free position in which the gripping pin is able to perform a vertical flexing movement with respect to its support. The two supports are interconnected by a horizontal transverse beam adjustable in length and movable in the vertical direction together with the supports. When handling the reels, relatively large masses have to be moved. Still another disadvantage is that height differences possibly occurring between the central holes due to reel deformations can be compensated for only within the rather small flexible movement of the suspending rods, because the supports are interconnected by the transverse beam and cannot be moved independently of each other. The spring-lever-joint construction, required for the flexible movement of the suspending rods, requires room on the side of the suspending rod and makes the support larger, which hampers working around the reel.

Still another disadvantage of the prior art apparatus is that the gripping pins cannot be secured completely rigidly to the frame in the reeling position. The supports of the suspending rods are provided with abutments against which the gripping pins may be pressed in the reeling position. However, since the supports are vertically movable along the columns, a small disadvantageous clearance always remains between the support and the column. In an attempt to avoid this, the suspending rod including its operating motor has been mounted on a base which is pivotedly fastened to the support and provided with two slide bearings pressing against opposite slide surfaces in the column. The object has been to cause the base to pivot relative to the column so that the slide bearings of the base grip firmly the column when the gripping pin is pressed by the operating motor against the abutment of the support. Such a way of removing the clearance between the support and the column, however, complicates the construction and increases costs.

Cable reeling apparatuses of other types are also known from the prior art. German Offenlegungsschrift 1 474 238 and U.S. Patent Specification 3,123,314 disclose horizontal structures in which the reel lifting arms are mounted vertically pivotably on a horizontal pivot shaft positioned at the side of the reel. This structure, however, requires a relatively large floor space beside the reel, whereby the other manufacturing and handling devices are difficult to arrange to cooperate with the reeling apparatus.

German Offenlegungsschrift 25 19 070 discloses a portal-type structure in which the supports for the reel gripping means are mounted each on a separate column so that the supports are vertically displaceable on the columns. This structure is fairly simple, but relatively large masses still have to be displaced when moving the supports.

The object of the present invention is to provide an apparatus for reeling or unreeling a cable or the like. The apparatus avoids the above-mentioned disadvantages and enables the handling of reels of different sizes and even badly deformed reels with a simple but steady structure. This object is achieved by means of an apparatus according to the invention, which is characterized in that each stationary support comprises an abutment which in the uppermost position of the suspending arm supports the suspending arm rigidly to the frame through the support, and that each suspending arm is supported by the stationary support by means of a spring member which in the lowered gripping position of the suspending arm allows a flexible movement of the suspending arm with respect to the support in the axial direction of the suspending arm and a horizontal swinging movement in a plane perpendicular to the axis of the reel.

The invention is based on the idea that the suspending arms can be allowed to be lowered over a relatively long distance in the vertical direction, provided that the gripping means can be reliably supported to their supports in the raised reeling position. The large vertical lowering movement enables a relatively wide horizontal movement of the gripping means at the lower end of the suspending arm in a plane perpendicular to the axis of the reel when the suspending arm is pivoted to the support at its upper end. The spring member allows a small flexible movement of the suspending arm in the vertical direction. In addition the suspending arm is able to swing on the spring member. So the gripping means can be inserted into the central hole of the reel irrespective of a possible wrong position of the reel.

The stationary support, which is vertically immovable with respect to the frame, is completely free from clearance. If a vertically movable support is used, the appearance of clearance is difficult to avoid. The vertical slide bearings required in a movable support are also avoided. Thus, the gripping means can be secured rigidly to the frame by means of the stationary support.

The following advantages will be achieved over the apparatus of Finnish Patent Specification 60542: Since the supports for the suspending arms are fastened vertically immovably to the frame of the apparatus, no machineries are needed for a vertical movement of the supports. Since both suspending arms can be moved independently of each other over a wide range in the vertical direction, it is easy to compensate for even major height differences between the central holes of deformed reels or reels positioned on an uneven surface. As the gripping means supporting the reel are always lifted against the fixed abutments of the stationary supports irrespective of the diameter of the reels, the reels will always be positioned on a constant working height, that is, in an ergonomically appropriate position, thus avoiding working at very low working levels with small reels. Due to the fixed mounting of the supports, a rigid, steady support frame is achieved. As the gripping means are secured rigidly to the support, which, in turn, is fixed rigidly to the column, the reel is supported very firmly in the reeling position. As no spring-lever arrangement is needed for the suspending arms at their lower ends, the support is more "slender" so that it does hamper working around the reel, e.g., when inserting the end of the cable into the reel. Since the transverse beam of the portal-structure frame is not moved when displacing the suspending arms in the vertical direction, the masses to be moved remain low and the portal frame is very steady.

In the following the invention will be described in greater detail with reference to the attached drawings, in which FIGS. 1 and 2 are side views of one preferred embodiment of the apparatus when handling the largest and the smallest reel, respectively;

Figure 2:
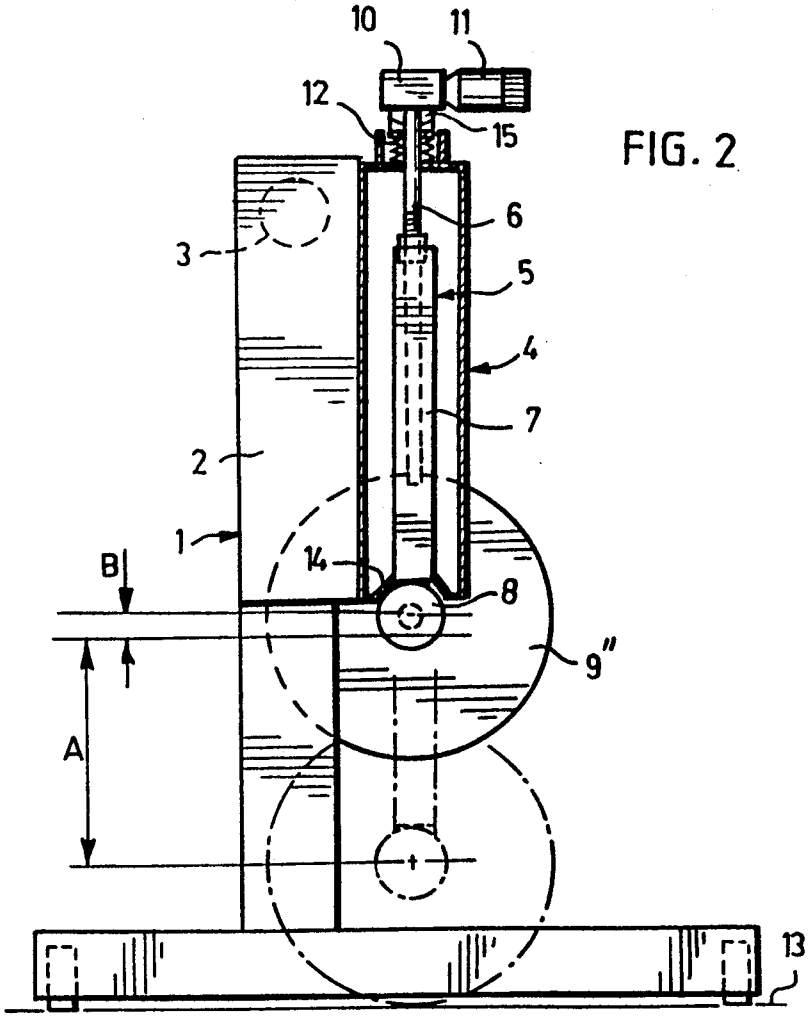
Figure 1:
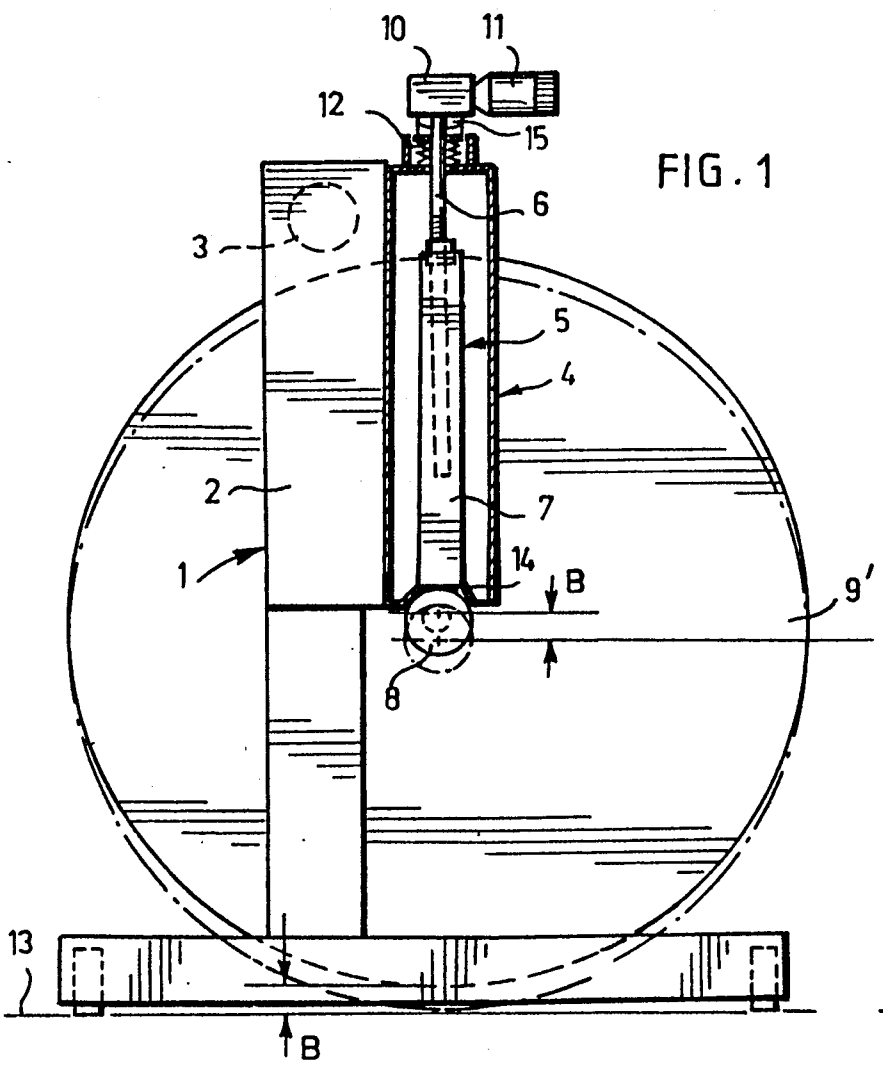
Figure 3:
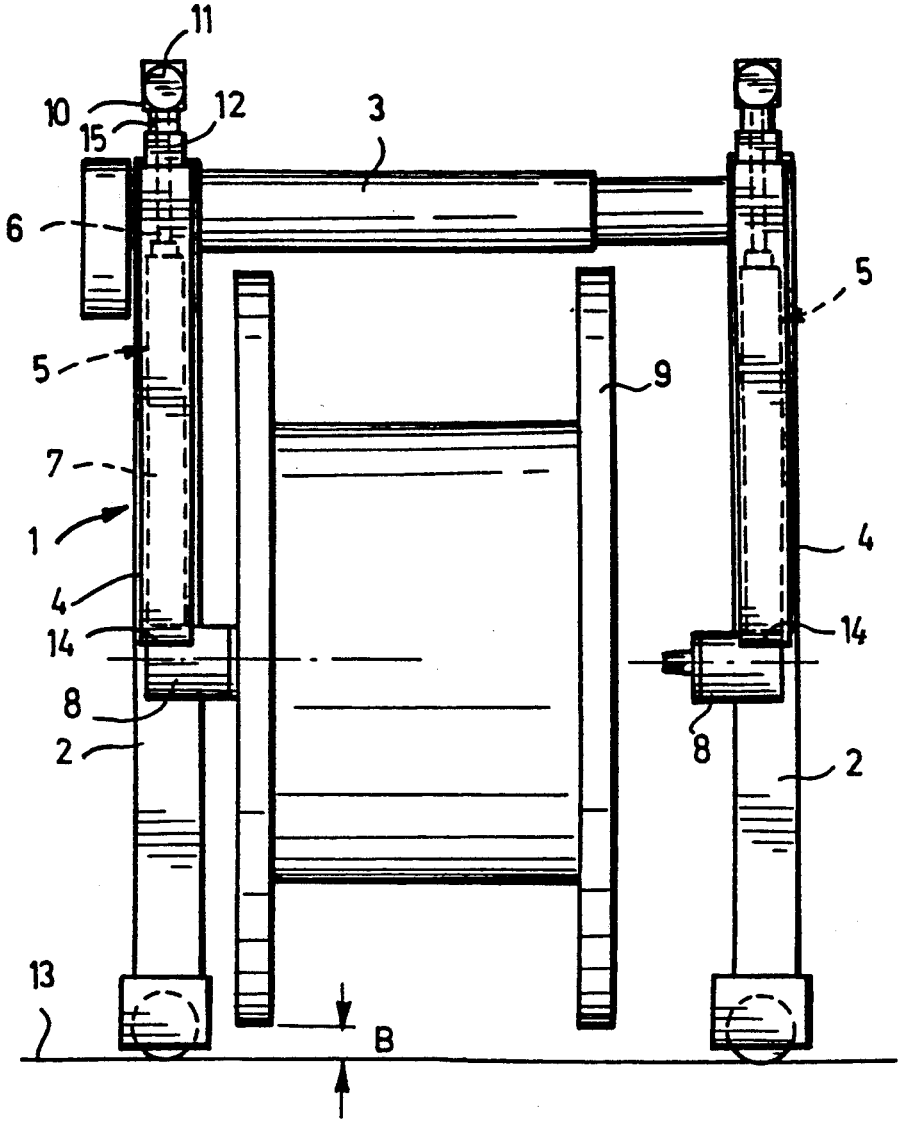
FIG. 3 is a front view of the apparatus.

The cable reeling apparatus shown in FIGS. 1 to 3 of the drawing comprises a portal-type frame 1 comprising two support columns 2 and an interconnecting transverse beam 3 which can be shortened and extended in the longitudinal direction of the beam by means of operating means not shown to adjust the distance between the columns for different reel widths. The apparatus further comprises two supports 4 each fastened rigidly to its own column.

Both supports are provided with a vertical suspending arm 5 comprising a screw rod 6 mounted rotatably but axially immovably on the support, and a gripping rod 7 mounted unrotatably but axially slideably with respect to the support. The gripping rod 7 is in screw engagement with the screw rod and its lower end is provided with a gripping pin 8 to be inserted in a central hole of a reel 9 to grip the reel. The screw rod is connected through a gear case 10 to a motor 11. The gear case is mounted by means of a ball joint 15 on a spring 12 supported by the support. The spring allows a small vertical flexible movement of the screw rod and the joint allows a swinging movement in a vertical plane perpendicular to the transverse beam 3.

The screw rod and the gripping rod of the suspending arm are such in length that the gripping pin 8 of the gripping rod can be moved vertically over a distance A between the central hole of the smallest, reel 9'' and that of the largest reel 9' and additionally over a distance B required for raising the reel sufficiently over a base 13 to ensure free rotation of the reel.

The lower portion of each support comprises a fixed abutment 14 forming a downwardly opening support groove against which the lower end of the gripping rod rests when the gripping rod is positioned in the raised reeling position.

To grip the reel, the gripping pins of both supports are lowered in alignment with the central holes of the reel to be handled, whereafter the columns are displaced towards each other, so that the gripping pins grip the reel. Thereafter the gripping rods are lifted by means of the motors until the lower ends of the rods are positioned in the grooves of the abutments 14 provided in the supports. The lifting movement first compresses the spring and then pulls the gripping rods tightly into their grooves.

It is noted that in order to lift reels of different sizes the gripping rods only have to be moved while the supports remain stationary. The masses to be moved are thus very small. The frame is very steady as the supports are positioned immovably on the support columns. As the gripping rods are moved independently of each other, the gripping pins can be displaced to different heights according to the position of the central holes of a slanting reel in the vertical direction. All the reels are lifted to the same ergonomic working level.

Figure 4:
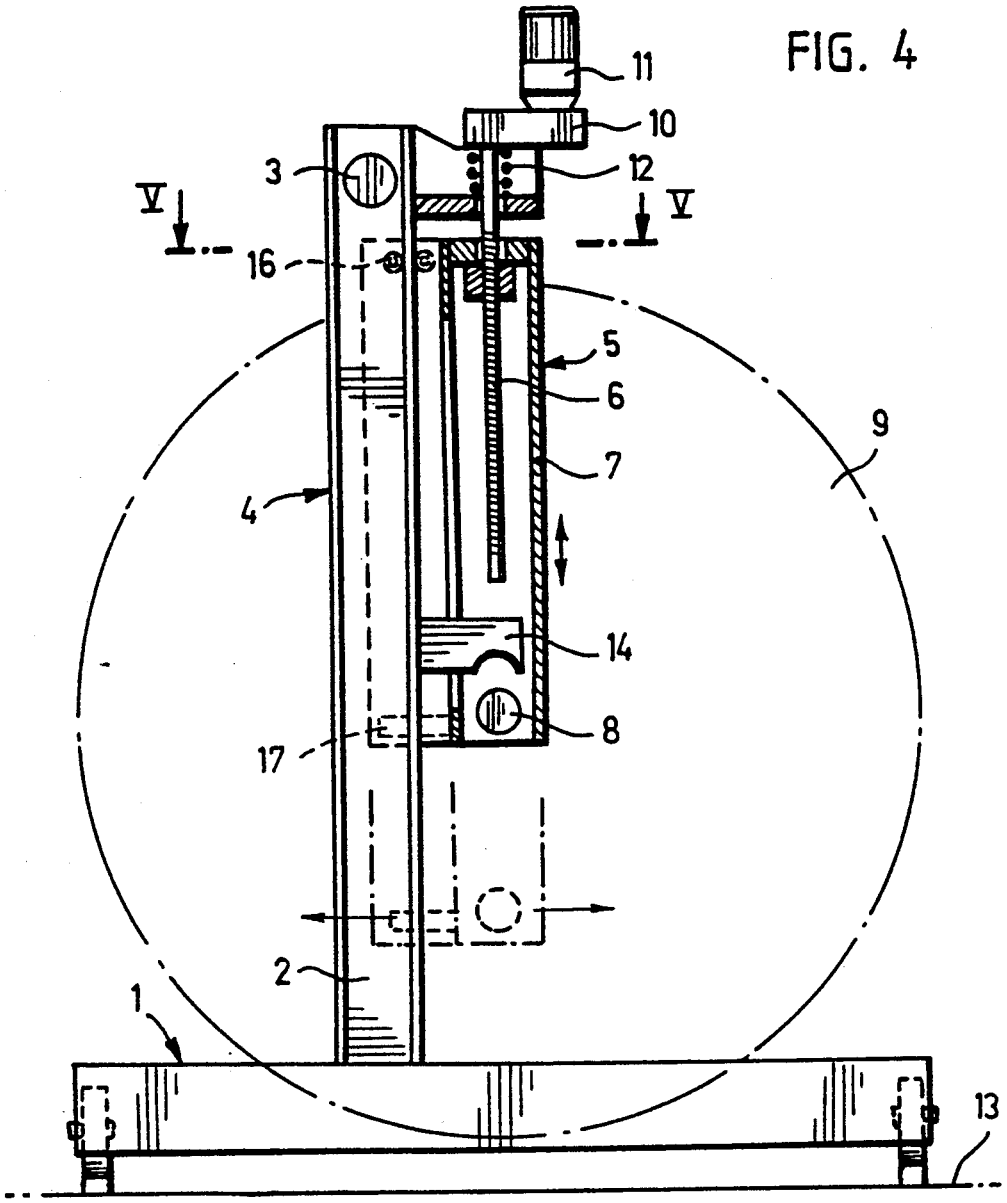
FIG. 4 is a side view of another embodiment of the reeling apparatus.
Figure 5:
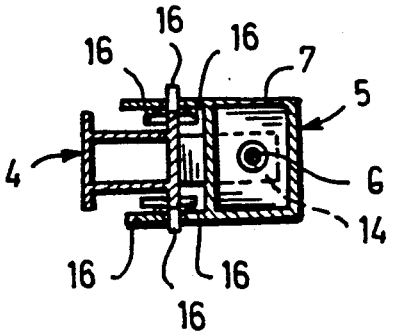
FIG. 5 is a sectional view along line V—V shown in FIG. 4.

In the embodiment of the reeling apparatus shown in FIGS. 4 and 5, the same reference numerals as in FIGS. 1 to 3 are used for corresponding parts. This embodiment differs from the preceding one mainly only in that the support 4 is a part of the column 2 of the frame and forms an upper extension of the column. In the suspending arm formed by the parts 6 and 7, the movable part 7 is slightly different from that of the first embodiment. Guide rolls 16 contacting against the vertical flanges of the support 4 are arranged at the upper end of part 7, while the lower end is provided with rolls 17 allowing a swinging movement of part 7 in a vertical plane perpendicular to the axis of the gripping pin 8, as shown by arrows in FIG. 4.

The drawings and the description related thereto are only intended to illustrate the idea of the invention; in its details, the apparatus of the invention may vary within the scope of the claims. Instead of fastening the supports to the columns, the supports can be mounted as separate modules on a fixed transverse beam of a portal-type frame or on an upper support rail system in such a way that the supports are movable longitudinally of the transverse beam or the rail system, respectively, in accordance with different reel widths. In the latter case, the reel system acts as the frame of the reeling apparatus. In place of gripping pins, the suspending arms may be provided with gripping means of some other kind, such as gripping hooks. It is also possible that the support is formed wholly or partly by the frame (FIGS. 4 and 5). For instance, when the support column is U-shaped in cross-section, the suspending arms and the power means can be mounted within the column, whereby the column acts as a support. When the suspending arm is positioned within the support column immediately below the transverse beam interconnecting the columns, the bending torque exerted on the column by the weight of the reel can be minimized. In place of mechanical lifting means, the suspending arm can be displaced by means of a pressure fluid cylinder.

I claim:

1. An apparatus useful for reeling or unreeling a cable on a reel comprising:

(a) a frame comprising two vertical support columns horizontally displaceable with respect to each other in accordance with the axial width of a reel to be gripped;

(b) two supports, each fastened rigidly to one of said columns;

(c) two vertically extending suspending arms, each mounted on one of said supports and being provided at the lower end thereof with gripping means for gripping a center axis of said reel and being vertically displaceable, with respect to the supported on which it is mounted, over a distance corresponding to the sum of a vertical difference between the center of a largest reel to be gripped and the center of a smallest reel to be gripped and a distance over which said largest reel is to be raised to ensure free rotation of said reel;

(d) power means for vertically displacing each of said suspending arms with respect to said supports;

(e) each of said supports having a fixed abutment which, in an uppermost position of the suspending arm mounted thereon, supports the suspending arm rigidly with respect to the frame through the support; and (f) each of said suspending arms being supported on one of said supports by means of a spring member which in a lowered gripping position of the suspending arm allows a flexible movement of the suspending arm with respect to the support in the longitudinal direction of the suspending arm and a horizontal swinging movement in a plane perpendicular to the axis of said reel being gripped.

2. An apparatus according to claim 1, wherein each of said suspending arms comprises a first lower rod and a second upper rod, said rods being longitudinally movable with respect to each other, said first rod being provided with said gripping means for gripping the reel and said second rod being fastened longitudinally stationary to the support and connected to the power means.

3. An apparatus according to claim 1 or 2, wherein each of said suspending arms is supported on one of said supports by a bearing allowing the suspending arm to swing on the bearing in a vertical plane perpendicular to the axis of said reel.

4. The apparatus of claim 1 or 2, wherein each of said suspending arms is supported on one of said supports by a spring allowing the suspending arm to flex in the vertical direction.

* * * * *

UNITED STATES PATENT AND TRADEMARK OFFICE

CERTIFICATE OF CORRECTION

PATENT NO. : 5,242,127

DATED : September 7, 1993

INVENTOR(S) : Vesa Jaaskelainen

It is certified that error appears in the above-indentified patent and that said Letters Patent is hereby corrected as shown below:

Claim 1, column 6, lines 14-15, "supported" should read --support--.

Signed and Sealed this

Twenty-second Day of March, 1994

Bruce Lehman

*Attest:*

BRUCE LEHMAN

*Attesting Officer*

*Commissioner of Patents and Trademarks*